US010159289B2

(12) United States Patent
Oborina

(10) Patent No.: US 10,159,289 B2
(45) Date of Patent: Dec. 25, 2018

(54) LADIES UNDERGARMENT AND FASTENER

(71) Applicant: Elena Vladimirovna Oborina, Odessa (UA)

(72) Inventor: Elena Vladimirovna Oborina, Odessa (UA)

( * ) Notice: Subject to any disclaimer, the term of this patent is extended or adjusted under 35 U.S.C. 154(b) by 0 days.

(21) Appl. No.: 15/524,631

(22) PCT Filed: Apr. 7, 2016

(86) PCT No.: PCT/UA2016/000041

§ 371 (c)(1),
(2) Date: May 5, 2017

(87) PCT Pub. No.: WO2016/163969

PCT Pub. Date: Oct. 13, 2016

(65) Prior Publication Data

US 2017/0325516 A1 Nov. 16, 2017

(30) Foreign Application Priority Data

Apr. 7, 2015 (UA) ..... a201503240

(51) Int. Cl.

| | |
|---|---|
| ***A41C 1/06*** | (2006.01) |
| ***A41B 9/08*** | (2006.01) |
| ***A41C 3/00*** | (2006.01) |
| ***A41F 15/00*** | (2006.01) |
| ***A41C 3/08*** | (2006.01) |

(52) U.S. Cl.

CPC ..... *A41C 1/06* (2013.01); *A41B 9/08* (2013.01); *A41C 3/0007* (2013.01); *A41C 3/08* (2013.01); *A41F 15/002* (2013.01); *A41C 3/0078* (2013.01)

(58) Field of Classification Search

CPC ..... A41C 1/06; A41C 3/0007; A41F 15/002; A41B 9/08

USPC ..... 450/81, 41, 85–88

See application file for complete search history.

(56) References Cited

U.S. PATENT DOCUMENTS

| | | | | |
|---|---|---|---|---|
| 4,245,644 | A | 1/1981 | Evans | |
| 5,045,019 | A | 9/1991 | Capasso et al. | |
| 6,547,636 | B1 | 4/2003 | Cato | |
| 2003/0236054 | A1 * | 12/2003 | Chen | A41C 3/02 450/82 |
| 2005/0064790 | A1 | 3/2005 | Mone et al. | |

(Continued)

FOREIGN PATENT DOCUMENTS

| | | | |
|---|---|---|---|
| FR | 1414902 | A | 10/1965 |
| GB | 2463888 | A | 3/2010 |

(Continued)

OTHER PUBLICATIONS

International Search Report for PCT/UA2016/000041—the whole document.

*Primary Examiner* — Gloria Hale

(57) ABSTRACT

A ladies undergarment in the form of a body, comprising shaping cups, support elements (1), a length adjuster (10), connecting means (2, 3), where, as support elements, only vertical support elements (1) are used, which fasten to the upper and lower side parts of the shaping cups with the aid of connecting means (2, 3), and connecting means (2) consists of a closed portion, which is sewn into a vertical support element (1), and an open portion having an elongated G-shape.

7 Claims, 4 Drawing Sheets

(56) References Cited

U.S. PATENT DOCUMENTS

| | | | | |
|---|---|---|---|---|
| 2005/0112996 | A1* | 5/2005 | Buehler | A41C 3/02 450/58 |
| 2009/0258572 | A1* | 10/2009 | Chayo | A41C 3/0028 450/39 |
| 2013/0237124 | A1* | 9/2013 | Hall | A41C 3/00 450/38 |
| 2014/0364037 | A1 | 12/2014 | Bailey et al. | |

FOREIGN PATENT DOCUMENTS

| | | | |
|---|---|---|---|
| JP | 2013121474 | A | 6/2013 |
| RU | 2096006 | C1 | 11/1997 |
| UA | 49983 | C2 | 10/2002 |
| UA | a201503240 | A1 | 10/2016 |
| WO | 0103525 | A1 | 1/2001 |
| WO | 03094641 | A1 | 11/2003 |
| WO | 03096831 | A1 | 11/2003 |

* cited by examiner

LADIES UNDERGARMENT AND FASTENER

FIELD OF THE INVENTION

The invention relates to light industry and can be used for manufacturing of ladies undergarment, in particular, bras, swimwear, corsets, tops, etc.

BACKGROUND OF THE INVENTION

Currently, many designs and types of bras and corsets are known, which are adopted to satisfy different women's needs. However, the main shape and configuration for all these products is the same from the very beginning of the bra creation. This includes shaping cups, horizontal and vertical support elements and adjusting elements. Such a design remains the same for majority of variations of ladies underwear, which are currently known. (The patent application of the Russian Federation No. 2096006, IPC A41C 3/00, 20 Nov. 97, bulletin No. 32; the patent application of the Russian Federation No. 1514324A1, IPC A41C 3/00, 15 Oct. 89, bulletin No. 38; the patent application of Ukraine No. 49983, IPC A41C 3/00, 15 Oct. 2002, bulletin No. 10; U.S. Pat. No. 4,245,644, 20 Jan. 1981, U.S. Pat. No. 5,045,019, 3 Sep. 1991 etc.).

However, such designs not always satisfy one of the main women's needs, at which initially all efforts of inventors, designers and tailors were aimed when creating a corset and then a bra. It is all about aesthetics of the woman's breasts and generally about the upper part of the body.

Therefore one of the disadvantages of bras is necessity for using of vertical support elements, such as shoulder-straps, slings, ribbons and the like, which support the main part of the undergarment. Such shoulder-straps fasten to the upper part of the shaping cups from the front side and over the shoulders on the back to a horizontal support portion of the bra forming two equal stripes on the woman's back, in parallel to the shoulder blades.

Such a design is ineffectual in the case when a woman wants to put on evening dress or any other dress having open back or another part of the woman's posture, since shoulder-straps completely extinguish the designer's idea, a feel of lightness of the dress and a feel of elegance of woman's body.

The bra designs with transparent shoulder-straps are known, however, transparency of such shoulder-straps is relative, and they are still visible on the woman's body. Furthermore, such shoulder-straps do not allow the woman's skin to breathe thus increasing perspiration in places of contact with the skin, which leads to chafing, since the material is a kind of plastic and is not very durable as such.

The designs, which do not have vertical support elements of the bra at all, are also known, however, in said designs either stiffer horizontal support elements, such as wires, plastics and the like, or high elasticity materials are used. However, these materials also cause discomfort during prolonged wearing and can be harmful to the woman's health.

The devices for relocation of shoulder-straps of the bra in order to hide them under the cloth are also known. For example, a fastener for retaining and bringing the shoulder-straps together into V-shape is disclosed in JP 2011288680. However, such a device does not meet the disadvantage related with the open back, but merely mitigate visibility of the shoulder-straps near the armpits.

An adjustable bra, which enables the woman to adjust the support, is also known. The bra comprises at least one shoulder-strap and a horizontal support strap. Fastening of the shoulder-strap to the horizontal support strap can be adjusted for attachment at a plurality of positions along the element. The bra may comprise a second shoulder-strap, which is also configured for attachment at a plurality of positions along the support element (U.S. patent application Ser. No. 14/177,196 of 10 Feb. 2014).

Such a design makes it possible to remove shoulder-straps from the places, where the naked body can be observed, however, they are not removed completely, since the main element of the design is the horizontal support strap to which the shoulder-straps are attached. Such a strap does not allow for providing entirely open back.

The closest analogue is the device for fastening of the shoulder-straps to the garment comprising a guiding element configured for fastening to said garment, and a slider connected to the shoulder-strap, the slider being shaped and dimensioned for sliding engagement with the guiding element (WO 03/096831 (27 Nov. 2003).

This analogue has the same significant disadvantage as in the previous case, the problem of the shoulder-straps can not be solved, as the horizontal support strap makes it impossible to provide entirely open back. Furthermore, the device according to the closest analogues is quite complicated from the technical point of view, resulting in a short lifetime and failure of some elements of the device, which therefore leads to impossibility to use the bra at all.

Taking into account intimate nature of the bra, abrupt failure of some elements thereof may have very negative effects.

THE SUMMARY OF THE INVENTION

The main object of the invention is to develop a ladies undergarment in the form of a body, which due to presenting of new elements and new shapes of already known elements, and relative positioning thereof makes it possible to provide entirely open back of a woman, while maintaining physiologically comfortable breast support.

The above mentioned object is achieved by providing a ladies undergarment in the form of a body, comprising shaping cups, support elements, a length adjuster, a fastener and detachment means, wherein, as support elements, only vertical support elements are used, which fasten to the upper and lower side parts of the shaping cups with the aid of the fastener and detachment means, the fastener consisting of two portions, wherein one of the portions is closed and sewn into the vertical support element, and the other portion is open in the form of an elongated G-shape, to enable fastening of the fastener to other portions of the ladies undergarment.

The fastener has a shape, which consists of two portions, where one of the portions is closed and is sewn into the vertical support element, and the other portion is open having an elongated G-shape and has a length not less than 3 times bigger than that of the closed portion, enabling connection of the fastener with other portions of ladies undergarment in vertical and horizontal positions.

Furthermore, the shaping cups have adhesive base on the upper part.

Furthermore, the shaping cups have stiffening elements.

Furthermore, the length of the support elements can be adjusted.

Furthermore, the support elements have detachment means for detaching from the shaping cups.

Furthermore, relative position of the support elements can be changed.

BRIEF DESCRIPTION OF THE DRAWINGS

Now the invention will be described with the aid of the following drawings, in which.

DETAILED DESCRIPTION OF THE INVENTION

Figure 1:
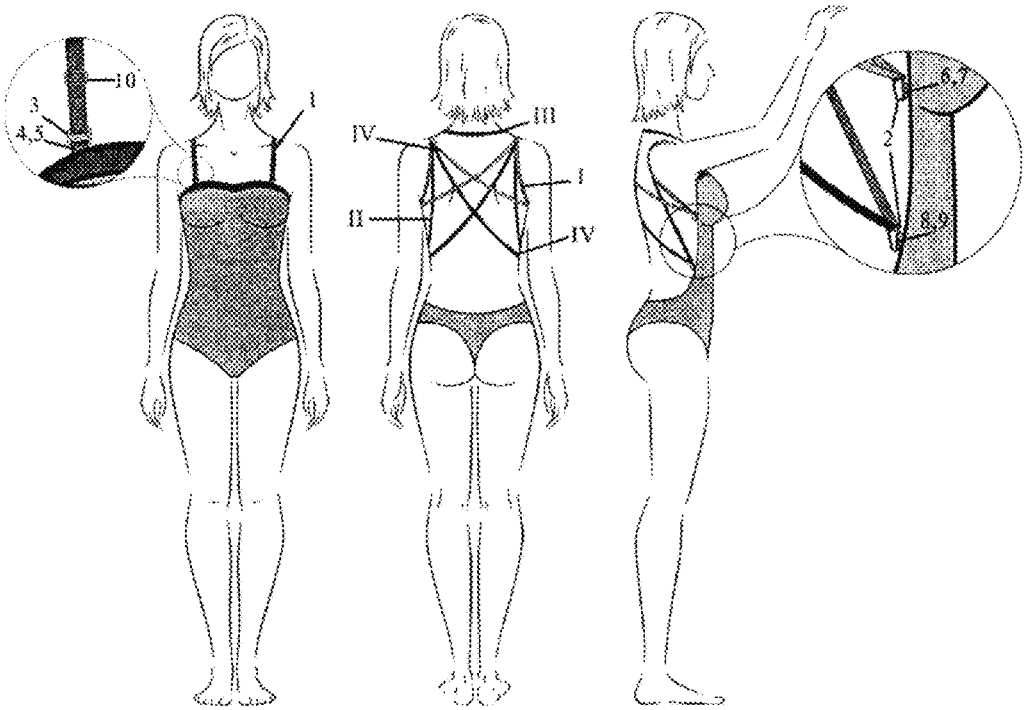
FIG. 1 is an overall view of the ladies underwear including all variants of fastening of support elements.

FIG. 1 is the overall view of the ladies underwear including all variants of fastening (I, II, III, IV, V). The figure illustrates the view of all the possible variants of fastening, providing the open back with the aid of different variants of attachment of the vertical support elements 1, a fastener 2 and means 3 for detachment of the ladies undergarment.

The means 3 for detachment engaging with loops 4, 5 are used on the front side. On the back side the vertical support elements 1 engage in different ways with loops 6-9, thereby providing invisibility when wearing open back clothes with the elements of any length or modification. A length adjuster 10 can be positioned on the vertical support elements 1, taking into account individual differences of each person the optimal length of the support element can be provided with the aid of the length adjuster.

Figure 2:
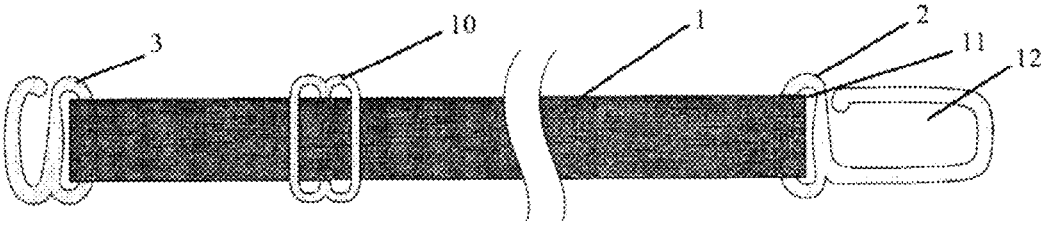
FIG. 2 is a view of connecting means.

FIG. 2 is the view of the vertical support element 1 and the fastener 2. The figure illustrates the overall view of the vertical support element 1 having the fastener 2, which consists of a closed portion 11 sewn into the vertical support element, and an open portion 12 having an elongated G-shape, the detachment means 3 and the length adjuster 10.

Figure 3:
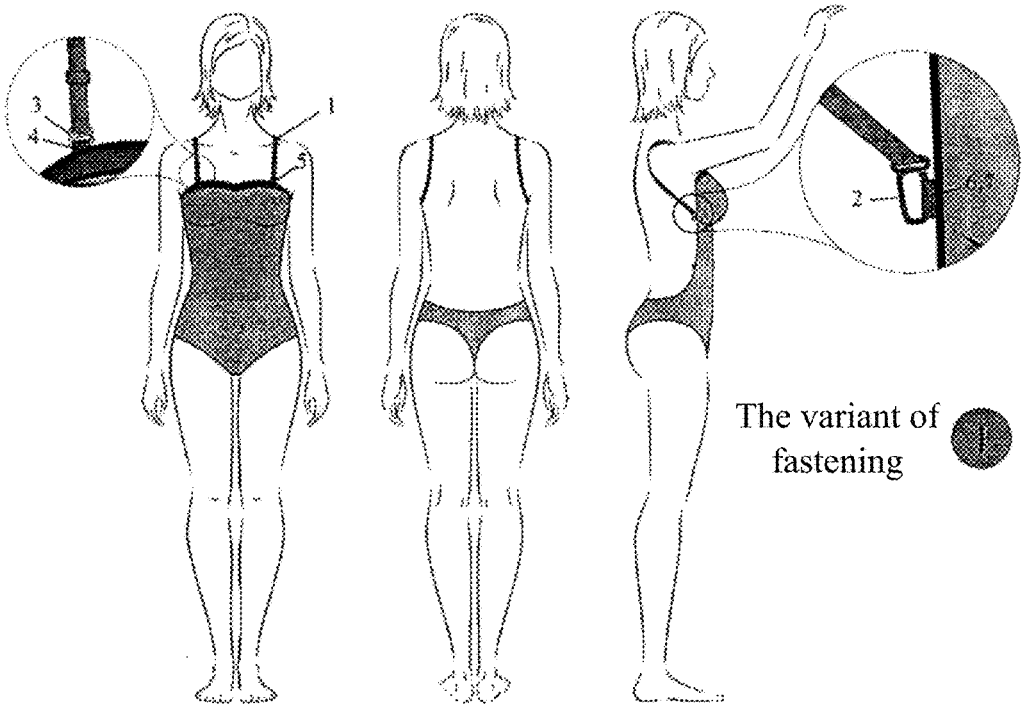
FIG. 3. is the first variant of fastening of the support elements.

In FIG. 3 the loops 4, 5 are located on the left side and on the right side of the ladies undergarment. The vertical support elements 1 are attached as follows: the detachment means 3 is inserted into the loop 4, 5. The second end of the vertical support element 1 comprises the fastener 2 and is inserted into the loop 6, 7 on the lateral side of shaping cups 13. In the same way the other vertical support element is attached on the other side. Therefore, it is clear that the variant mentioned above provides entirely open back.

Figure 4:
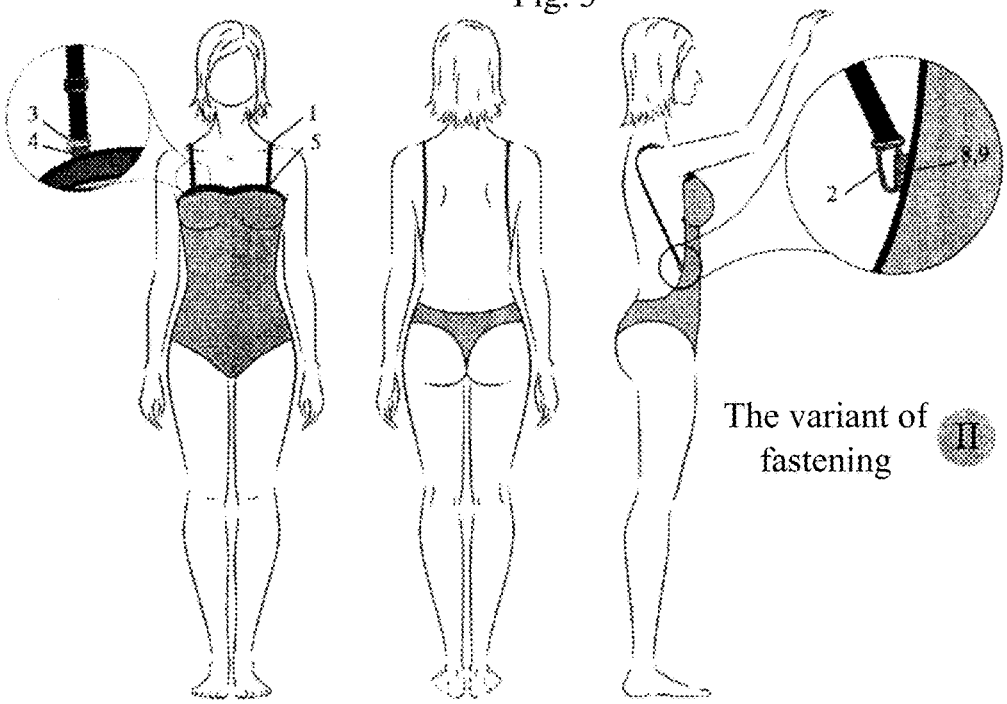
FIG. 4 is the second variant of fastening of the support elements.

In FIG. 4 the loops 4, 5 are located on the left side and on the right side of the ladies undergarment. The figure illustrates the vertical support elements 1 being attached as follows: the detachment means 3 is inserted into the loop 4, 5. The second end of the support element comprises the fastener 2 and is inserted into a lower loop 8, 9. In the same way the other vertical support element is attached on the other side. Therefore, it is clear that the above-mentioned variant of fastening provides entirely open back and a larger scye depth.

Figure 5:
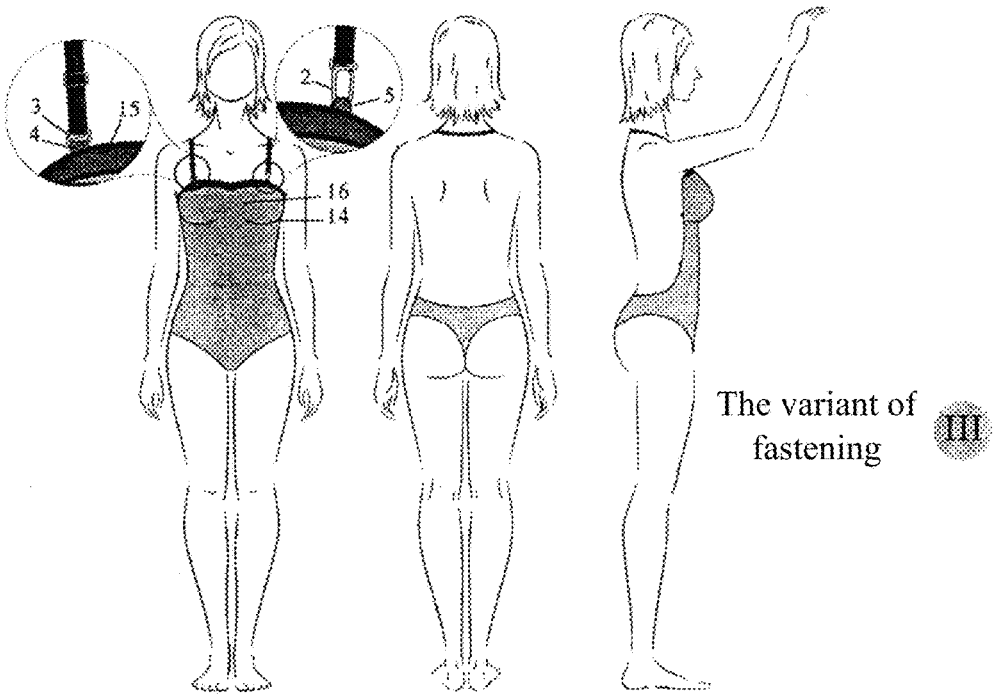
FIG. 5 is the third variant of fastening of the support elements.

In FIG. 5 the loops 4, 5 are located on the front side. In this variant, only one of the vertical support elements is used. The figure illustrates the vertical support element being attached as follows: the detachment means 3 is inserted into the loop 4. The second end of the support element comprises the fastener 2 and, bending over the neck, is inserted into the loop 5. Therefore, it is clear that the variant of fastening mentioned above enables entirely open back from all sides. Furthermore, for tighter holding of the shaping cups on the breast, the shaping cups 16 may comprise stiffening elements 14 and/or an adhesive strap 15 in the upper part of the cups.

Figure 6:
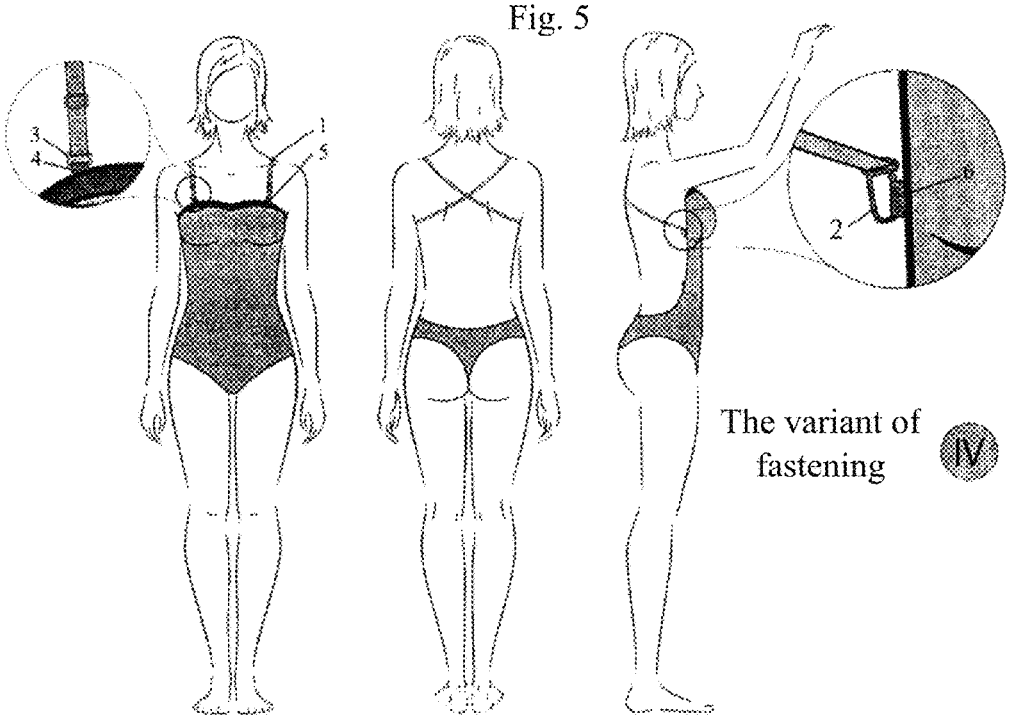
FIG. 6 is the fourth variant of fastening of the support elements.

In FIG. 6 the loops 4, 6 are located on the left side of the ladies undergarment, the loops 5,7 are located on the right side of the ladies undergarment. The figure illustrates the vertical support element 1 being attached as follows: the detachment means 3 is inserted into the loop 4. The second end of the support element comprises the fastener 2 and is inserted into the opposite loop 7. In the same way the other vertical support element is attached on the other side. This variant of fastening is ideally suited for strap clothing, which provides invisibility of the undergarment straps and creation of <<invisible undergarment>> effect.

Figure 7:
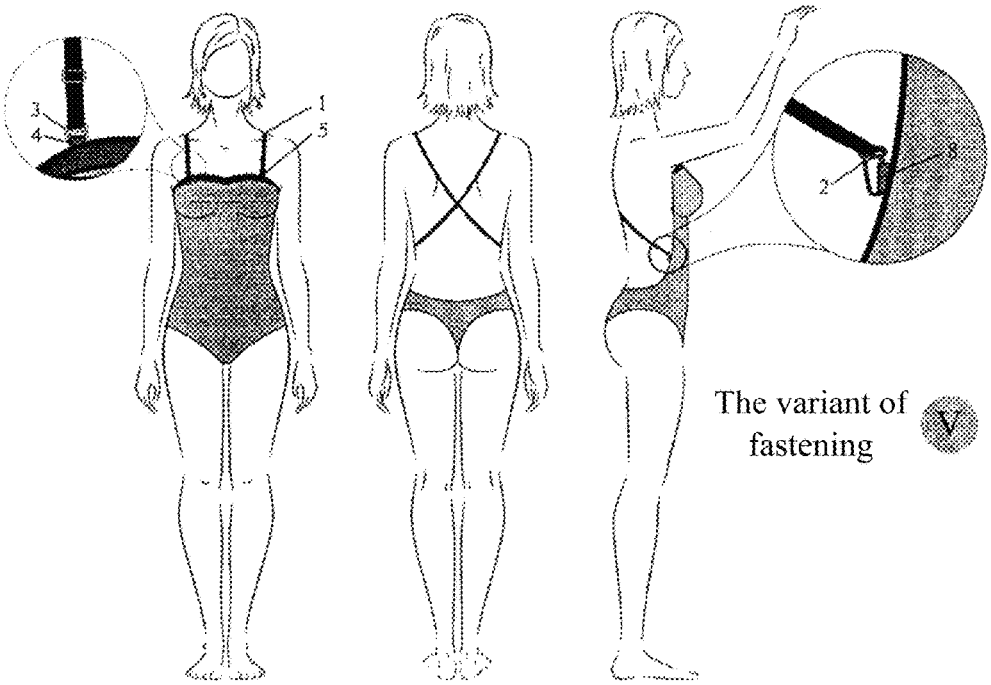
FIG. 7 is the fifth variant of fastening of the support elements.

In FIG. 7 the loops 4, 8 are located on the left side of the ladies undergarment, the loops 5, 9 are located on the right side of the ladies undergarment. The figure illustrates the vertical support element 1 being attached as follows: the detachment means 3 is inserted into the loop 4. The second end of the support element comprises the fastener 2 and is inserted into the opposite loop 9. In the same way the other vertical support element is attached on the other side. Thus, vertical support elements are attached crosswise. This variant of fastening is ideally suited for strap clothing, which provides invisibility of the undergarment straps and creation of <<invisible undergarment>> effect.

Therefore, it is understood from the description above that the provided ladies undergarment in the form of a body and the fastener can be used in any garment comprising at least one vertical support element, for example, in swimwear, undergarment, dresses, tops, sports wear, etc., and also in any other corresponding applications, for example, for medical use or for any other purposes.

The technical result of the invention consists in the social effect aimed at maintaining healthy and comfortable state of the woman, thereby increasing her self-confidence, sexuality, good mood and harmony, as well as decreasing economical expenses for a great number of garments.

The invention claimed is:

1. A ladies undergarment in the form of a body, comprising shaping cups, support elements, a length adjuster, a fastener and detachment means, wherein as the support elements, only vertical support elements are used, which fasten to an upper and a lower side parts of the shaping cups with the aid of the fastener and detachment means, the fastener consisting of two portions, wherein one of the portions is closed and sewn into the vertical support element, and the other portion is open in the form of an elongated G-shape, to enable fastening of the fastener to other portions of the ladies undergarment.

2. The ladies undergarment in the form of a body according to claim 1, wherein the shaping cups have an adhesive base on an upper part.

3. The ladies undergarment in the form of a body according to claim 1, wherein the shaping cups have stiffening elements.

4. The ladies undergarment in the form of a body according to claim 1, wherein a length of the support elements is adjustable.

5. The ladies undergarment in the form of a body according to claim 1, wherein the support elements have the detachment means for detaching from the shaping cups.

6. The ladies undergarment in the form of a body according to claim 1, wherein the relative position of the support elements is changeable.

7. A fastener, consisting of a closed and an open portions, wherein the open portion is formed as an elongated G-shape and is not less than 3 times longer than that of the closed portion, enabling connection of the fastener with other portions of a ladies undergarment in vertical and horizontal positions.

* * * * *